United States Patent [19]

Aoki

[11] Patent Number: 4,896,824

[45] Date of Patent: Jan. 30, 1990

[54] POUR SPOUT CONTAINER

[75] Inventor: Yoshiharu Aoki, Tokyo, Japan

[73] Assignee: Sigma Shigyo Kabushiki Kaisha, Osaka, Japan

[21] Appl. No.: 313,607

[22] Filed: Feb. 22, 1989

[30] Foreign Application Priority Data

Aug. 5, 1988 [JP] Japan ..... 63-103901

[51] Int. Cl.[4] ..... B65D 5/74

[52] U.S. Cl. ..... 229/125.42; 206/621.4; 206/621.8; 229/125

[58] Field of Search ..... 229/125, 125.42; 206/621.4, 621.5, 621.6, 621.8, 626

[56] References Cited

U.S. PATENT DOCUMENTS

| | | | |
|---|---|---|---|
| 2,095,720 | 10/1937 | Spalding | 206/621.5 |
| 2,348,140 | 5/1944 | Levin | 206/621.4 |
| 2,348,310 | 5/1944 | Rous | 229/125.42 |
| 2,362,942 | 11/1944 | Spalding | 229/125.42 |
| 2,969,904 | 1/1961 | Cottrill | 206/621.5 |
| 4,684,058 | 8/1987 | Weber | 206/621.4 |

FOREIGN PATENT DOCUMENTS

| | | | |
|---|---|---|---|
| 3521442 | 10/1966 | Fed. Rep. of Germany | 229/125.42 |
| 52-35216 | 8/1977 | Japan . | |

*Primary Examiner*—Gary Elkins

*Attorney, Agent, or Firm*—Wenderoth, Lind & Ponack

[57] ABSTRACT

A container for granular substances, having a mouth which opens diagonally and upwardly into a triangular shape at an upper part of a left side board. The mouth comprises a pasting piece, which is slightly higher than a front board and a rear board and a sliding board, consisting of an arcuate part and a flap piece contiguous to the circumference of the arcuate part. The sliding board is supported and slides between the inner surface of the front board and the outer surface of a tongue piece formed at the front board. The circumferential edge of the arcuate part always projects above a ceiling board, whether the mouth is opened or closed. The container ensures perfect sealing of granular substances contained therein while the mouth is closed.

1 Claim, 4 Drawing Sheets

POUR SPOUT CONTAINER

BACKGROUND OF THE INVENTION

1. Field of the Invention

This invention relates to a container for granular substances and includes a pour spout which is opened diagonally and upwardly into a triangular shape. More particularly, this container has a pour spout which is opened diagonally and upwardly into a triangular shape at an upper part of a left side board. While the spout is closed, it ensures sealing, namely, granular substances do not spill from any part of the container other than the spout. This container can be manufactured mechanically on a mass production basis.

2. Description of the Prior Art

A container of this type having a spout which is opened diagonally and upwardly was disclosed in the Japanese Utility Model Registration Application Publication No. 52-35216 (devised by the inventor of the present invention). This container has a spout which is opened diagonally and upwardly into a triangular shape and comprises an upper part of a left side board and a sliding board connected to a side edge of the upper part of the left side board. The sliding board is guided into and slides between a front side board and an inserting piece contiguous to a ceiling board. However, since the inserting piece is merely contiguous to the ceiling board through a fold line, the sliding board opening cannot be held satisfactorily between the inserting piece and the front side board and it is difficult to maintain the opened and closed state of the spout due to the restoring force of a fold line for the upper part of the left side board. Moreover, while the spout is open, the sliding board must be supported by hand and this results in a force acting inwardly of the container on the sliding board. Thus, the sliding board is shifted inwardly and as a result a gap is caused between the sliding board and the front side board and granular substances in the container spill through the gap. In addition, when the spout is closed, it cannot be closed perfectly.

SUMMARY OF THE INVENTION

The present invention has for its object the elimination of the disadvantages of a container with a pour spout to be opened diagonally and upwardly as mentioned above.

According to the present invention, satisfactory holding of a sliding board can be obtained and the opened and closed state of the spout are stabilized by providing a sliding board integral with the upper end of a pasting piece which contacts the inner surface of a left side board and by interposing and sliding the sliding board between a front side board and a tongue piece partitioned off the front side board and connected to a ceiling board. The pasting piece is formed such that the upper end thereof is slightly higher than the front side board and a rear side board, a small cut is made at an upper end portion of a folding line connecting the pasting piece to the rear side board and a fold line extends downward and diagonally from a lower end of the cut. The sliding board has an arcuate portion which is described by a lower end of the diagonal folding line as the center and the length to the upper end of the pasting piece as the radius and a flap piece contiguous to the circumferential edge of the arcuate portion. The circumferential edge of the arcuate portion of the sliding board always projects above the ceiling board and therefore, even if a force of acts on the sliding board inwardly of the container, the sliding board does not shift from the inner surface of the front side board and no gap is caused between the sliding board. the front side board and granular substances in the container are thus prevented from spilling from any part other than the spout.

BRIEF DESCRIPTION OF THE DRAWINGS

The accompanying drawings show an embodiment of the present invention, in which.

DESCRIPTION OF THE PREFERRED EMBODIMENT

The present invention has attained the above-mentioned object and is described below, with reference to the accompanying drawings showing a preferred embodiment.

Figure 2:
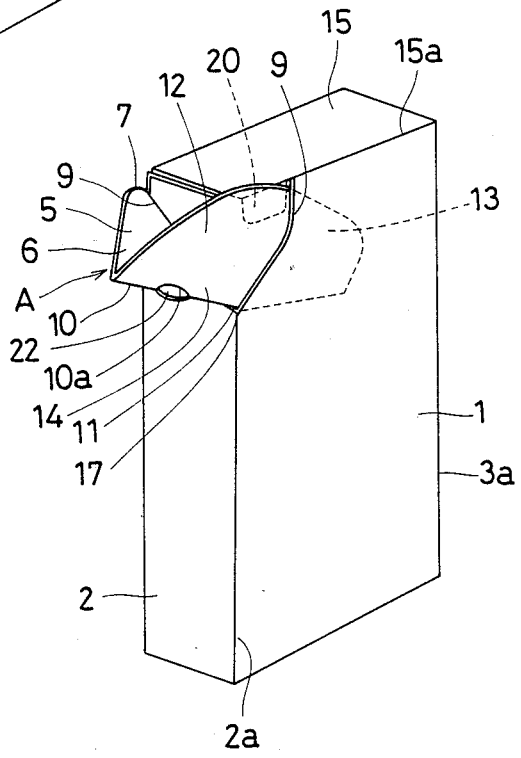
FIG. 2 is a perspective view of a container according to the present invention when opened.
Figure 3:
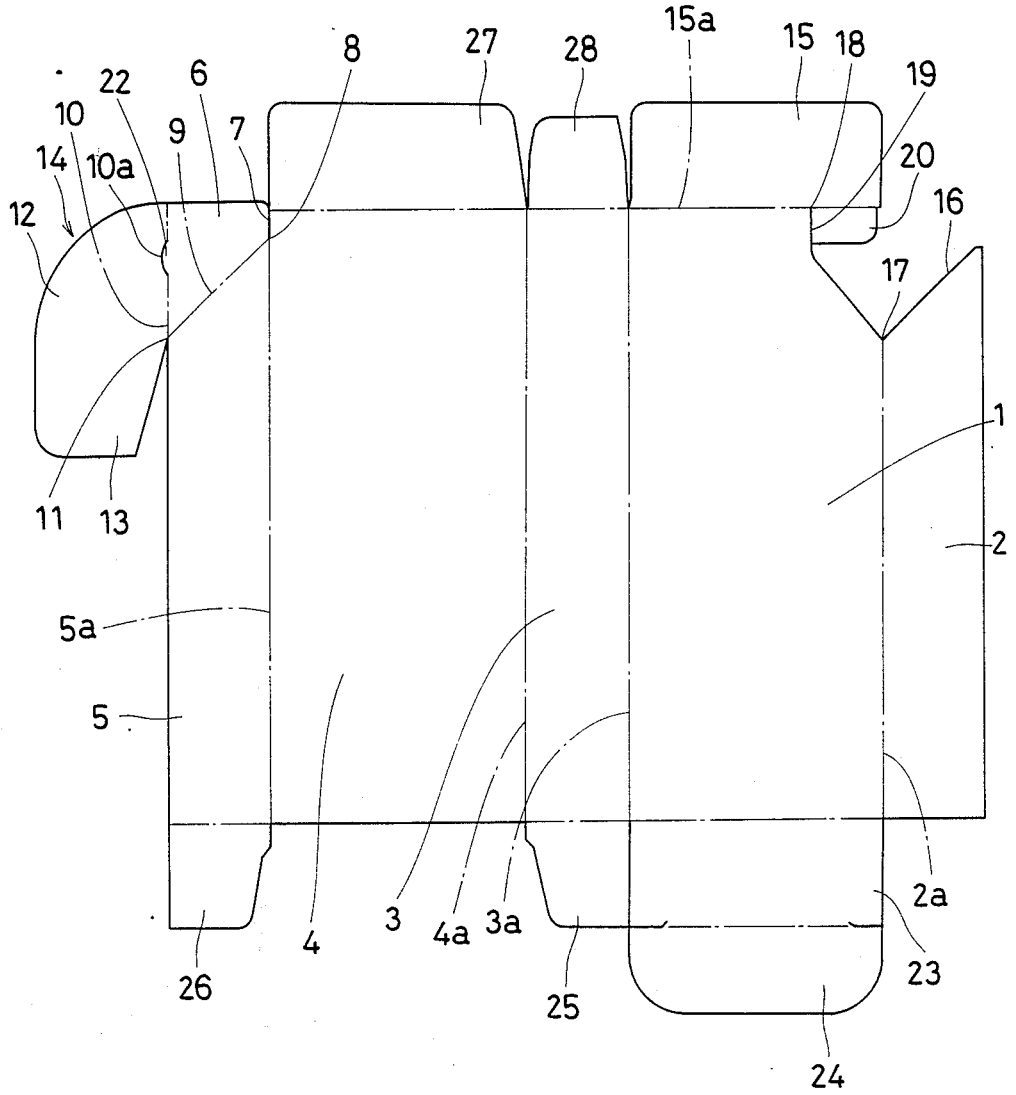
FIG. 3 is a plan view of a container blank according to the present invention.

As shown in FIG. 3, a left side board 2 and a right side board 3 are contiguous to respective sides of a front board 1, through a fold line 2*a* and a fold line 3*a*, respectively. A rear board 4 is contiguous to the right side board 3 through a fold line 42. A pasting piece 5 which will be adhered to the entire inner surface of the left side board 2 is contiguous to the rear board 4 through a fold line 5*a*. An upper end 6 of the pasting piece 5 extends slightly higher than the front side board 1 and the rear board 4, and a small cut 7 (about 5 mm from an upper end 6 of the pasting piece 5) is made between the rear board 4 and the pasting piece 5. A downward and diagonal fold line 9 starts at a lower end 8 of the cut 7 and crosses the pasting piece 5. A power spout A (FIG. 2) of triangular shape is composed by a part of the pasting piece 5 (above the folding line 9) and a sliding board 14 (to be described later). This spout is opened as shown by FIG. 2. A fold line 10 is provided at the side end (above the folding line 9) of the pasting piece 5. The sliding board 14 comprises an arcuate portion 12 which is a quadrant describe with a lower end 11 of the folding line 10 as the center and the length of the folding line 10 as the radius and a flat piece 13 contiguous to the circumference of the arcuate part 12. An arcuate slit 10*a* with both ends thereof on the folding line 10, is made in the sliding board 14 and thus a projection 22 contiguous to the pasting piece 5 is formed. With this arrangement, the spout A can readily be opened by laying a finger on the projection 22 projecting from the sliding board 14. A ceiling board 15 is provided at the upper end of the front side board 1 through a fold line 15*a*. As will be stated later, an upper end open part 29 of the container 21 is blocked by the ceiling board 15. A notch part 16 is made in the left side board 2 to correspond to the fold line 9. When the pasting piece 5 above the fold line 9 is folded outwardly at the fold line 9 as shown in FIG. 2, the upper part of the pasting piece 5 can be folded without any trouble. A lower end 17 of the notch part 16 and an intermediate part 18, near the left side board, on the folding line 15*a* are connected together with a cut 19, and a tongue piece 20 having rectangular shape is formed at the upper part of the front board 1 through the medium of the ceiling board 15 and the fold line 15*a*.

Figure 4:
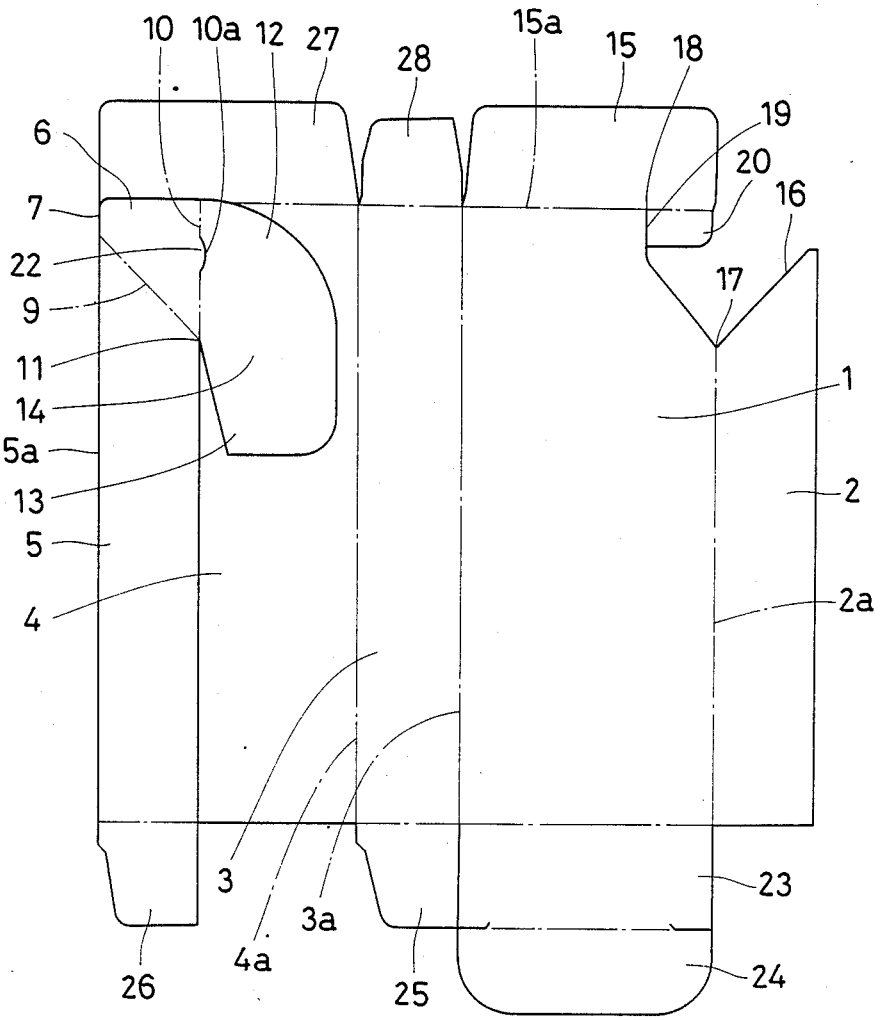
FIG. 4 is a plan view showing the blank of FIG. 3 partially assembled.
Figure 5:
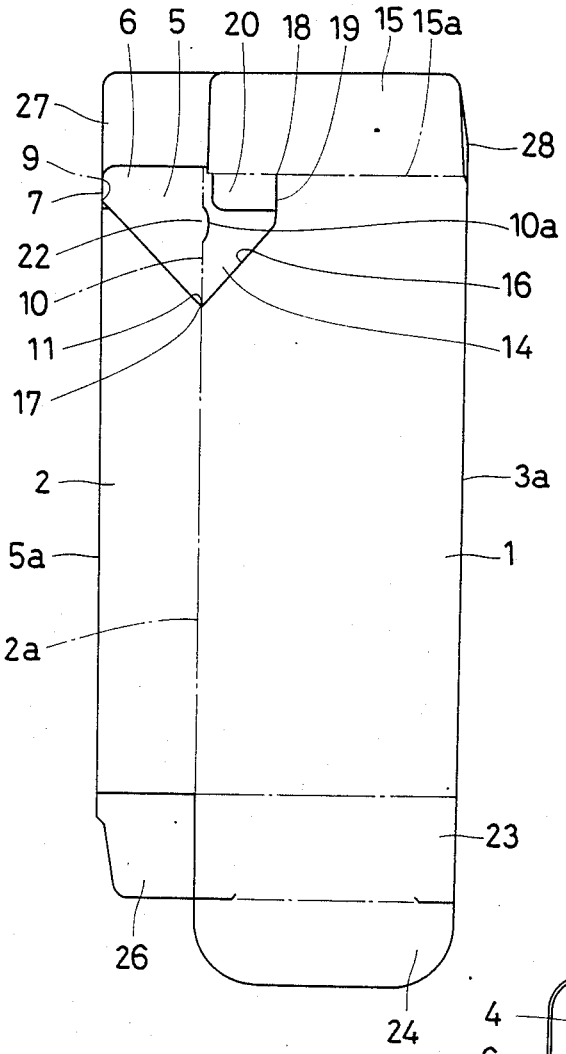
FIG. 5 is a plan view showing the blank of FIG. 3 partially assembled.

In manufacturing a container according to the present invention, as shown in FIG. 4, the pasting piece 5 is folded at the fold line 5*a*, together with the sliding board 14 for opening, toward the inner surface of the rear board 4. Adhesive is applied to an outer surface of the pasting piece 5 at the part below the folding line 9. Then, as shown in FIG. 5 the front board is folded at the folding line 3*a*, together with the left side board 2, toward the inner surfaces of the right side board 3 and the rear board 4. The inner surface of the left side board 2 is adhered to the outer surface of the pasting piece 5. By pressing the folding line 3*a* and 5*a* on a diagonal line, the front board 1, the right and left boards 2, 3 and the rear side board 4 are formed into a rectangular prism shape. Inserting pieces 25 and 26 at the lower end of the right side board 3 and pasting piece 5 are folded inwardly of the bottom surface of the prism shape. The inserting piece 24 of bottom board 23 is inserted into the inner surface of the lower end of the rear board 4 so as to block the bottom surface of the prism shape and thus a rectangular container 21 with its upper end opened is formed.

Figure 6:
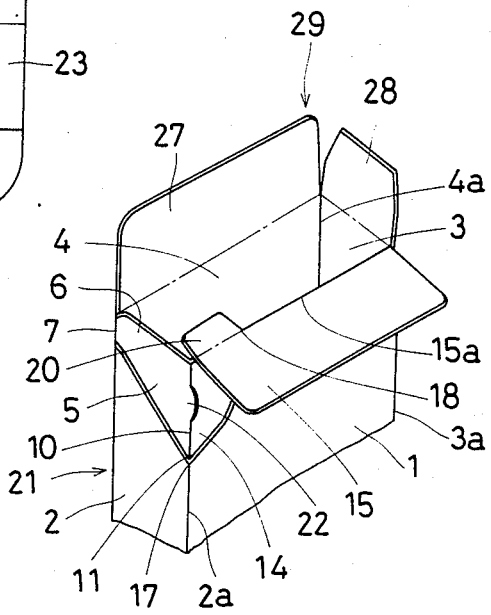
FIG. 6 is a perspective view of an upper end of a container.

As shown in FIG. 6, when the ceiling board 15 is brought down, the tongue piece 20 near the left side board 2 and connected to the ceiling board 15 extends over the circumferential edge of the arcuate part 12 of the sliding board 14 beyond the inner surface of the arcuate part 12. When the ceiling board 15 is restored to its original position, the sliding board 14 interposed between the front side board 1 and the tongue piece 20.

A folding-in piece 28 contiguous to the upper end of the right side board 3, an inner ceiling board 27 contiguous to the upper end of the rear board 4 and the ceiling board 15 are folded in order, inwardly of the upper end opened part 29 of the container 21. The ceiling board 15 and the inner ceiling board 27 are adhered together to block the upper end opened part 29. Thus, the container is completed.

Figure 1:
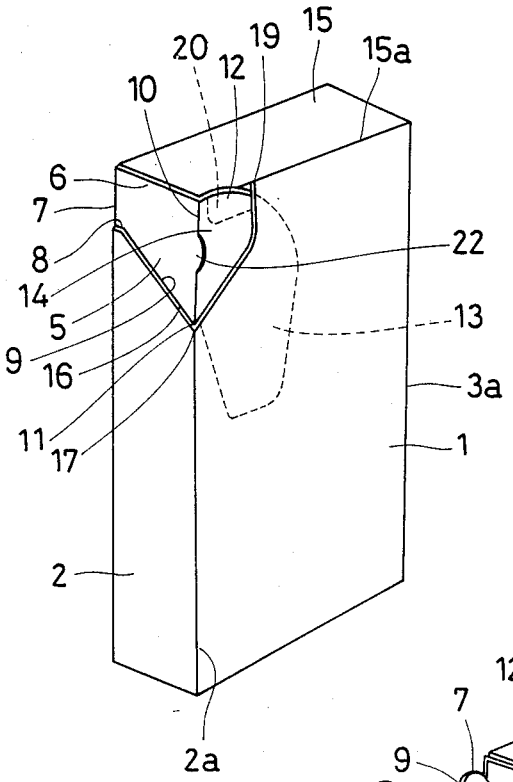
FIG. 1 is a perspective view of a container according to the present invention when closed.

In opening a finished container shown in FIG. 1, fingers are applied to the projection 22 which is connected to the upper part of the pasting piece 5 and projects from the sliding board 14 and the projection 22 is pulled outwardly, whereupon the pasting piece 5 at the part above the folding line 9 rotates about the folding line 9 while sliding the sliding board 14 between the inner surface of the front board 1 and the outer surface of the tongue piece 20 and opens in a triangular shape, as shown in FIG. 2. The opened state of the spout A of triangular shape is maintained stably. To close the spout A the upper part of the pasting piece 5 is pressed by a finger, rotates about fold line 9 and slides the sliding board 14 to block the container as shown in FIG. 1. The closed state of the spout A is maintained stably.

As stated above, in manufacturing a container according to the present invention the pasting piece 5 is folded at the fold line 5*a*, together with the sliding board 14, toward the inner surface of the rear board 4, as shown in FIG. 4. Adhesive is applied to the outer surface of the pasting piece 5 at the part below the fold line 9. As shown in FIG. 5, the front board 1 is folded, together with the left side board 2, toward the inner surfaces of the right board 3 and the rear board 4 and the inner surface of the left side board 2 is adhered to the outer surface of the pasting piece 5. Thus, the front board 1, the right and left boards 2, 3 and the rear board 4 are formed into a rectangular shape, as shown in FIG. 6, and the bottom is blocked by conventional means. When the ceiling board 15 is brought down in a frontward direction, the tongue piece 20 extends over the circumferential edge of the arcuate part 12 of the sliding board 14 beyond the inner surface of the arcuate part 12. When the ceiling board 15 is restored to its original position, the upper end is blocked by conventional means. Therefore, no difficulty is found in manufacturing these containers mechanically and these containers can be manufactured on a mass production basis, using a conventional box making machine.

As the sliding board 14 is held between the inner surface of the front board 1 and the outer surface of the tongue piece 20 by means of the restoring force of the tongue piece 20, and slides between the front side board 1 and the tongue piece 20, the opened and closed state of the spout A are maintained stably. Therefore, it is easy to dispense granular substances while the spout A is opened and the spout A is never opened accidentally after it is closed. When the container contains granular candies or the like, it is difficult to enter for dust the container and therefore the present invention provides sanitary containers.

As the arcuate portion 12 of the sliding board 14 is designed as a quadrant which is described with the folding line 10 as the radius and with the point 11 as the center, the circumferential edge of the arcuate part 12 always projects above the ceiling board 15, irrespective of whether it is closed or opened. Thus even if force is applied to the sliding board 14 inwardly of the container, the sliding board 14 will not shift inwardly of the front board 1. This means that no gap is formed between the sliding board 14 and the front board 1 and there is no fear that granular substances exit down through any part other than the spout.

What is claimed is:

1. A container for granular substances, comprising:

a pasting piece;

a rear piece connected to said pasting piece along a first fold line;

a right side piece connected to said rear piece along a second fold line;

a front piece connected to said right side piece along a third fold line;

a left side piece connected to said front piece along a fourth fold line, and an inner surface of said left side piece connected to a portion of an outer surface of said pasting piece;

bottom piece means connected to a bottom edge of each of said rear piece, said right side piece, said front piece and at least one of said pasting piece and said left side piece;

a first cut extending a distance down said pasting piece from a top edge thereof along said first fold line, said top edge extending above the top edge of each of said rear piece, said right side piece and said front piece;

a fifth fold line extending from a bottom of said first cut across said pasting piece to a free edge of said pasting piece, and the area of said pasting piece below said first fold line includes said portion of an outer surface;

a second cut extending from said fourth fold line near the intersection of said fifth fold line and said free edge of said pasting piece to a point on said top edge of said front piece, said point being spaced from said fourth fold line;

top piece means connected to said top edge of said rear piece and said right side piece and connected along a front edge thereof to said top edge of said front piece from said point to said third fold line;

a tongue piece connected to said front edge of said top piece means from said point to at least near said free edge of said pasting piece; and a sliding board connected along a sixth fold line to said free edge of said pasting piece from the intersection of said fifth fold line and said free edge of said pasting piece to said top edge of said pasting piece, at least a portion of a top edge of said sliding board extending above said top edge of said front board, said sliding board being in sliding contact with an outer surface of said tongue piece and an inner surface of said front piece.

* * * * *